US008109037B2

(12) United States Patent
Speyer et al.

(10) Patent No.: US 8,109,037 B2
(45) **Date of Patent: *Feb. 7, 2012**

(54) ACTIVE SEALING SYSTEM FOR SINGLE-HUNG DOOR/WINDOW

(75) Inventors: William Kip Speyer, Boca Raton, FL (US); Jonathan D. Thielmann, Delray Beach, FL (US); Don S. Solerno, Hollywood, FL (US)

(73) Assignee: Secura-Seal Technologies LLC, Bensalem, PA (US)

( * ) Notice: Subject to any disclaimer, the term of this patent is extended or adjusted under 35 U.S.C. 154(b) by 570 days.

This patent is subject to a terminal disclaimer.

(21) Appl. No.: 11/846,139

(22) Filed: Aug. 28, 2007

(65) Prior Publication Data

US 2008/0060276 A1 Mar. 13, 2008

Related U.S. Application Data

(63) Continuation-in-part of application No. 11/322,952, filed on Dec. 30, 2005, now Pat. No. 7,685,775, and a continuation-in-part of application No. 11/756,957, filed on Jun. 1, 2007, which is a continuation-in-part of application No. 11/425,377, filed on Jun. 20, 2006, now Pat. No. 7,624,539.

(51) Int. Cl.
*E06B 7/28* (2006.01)

(52) U.S. Cl. ..... 49/318; 49/316; 49/317; 49/320; 49/321

(58) Field of Classification Search ..... 49/303–307, 49/316–318, 320, 321
See application file for complete search history.

(56) References Cited

U.S. PATENT DOCUMENTS

| | | | | |
|---|---|---|---|---|
| 19,217 | A | | 1/1858 | Tinney |
| 313,742 | A | | 3/1885 | Kintner |
| 703,889 | A | | 7/1902 | Berry |
| 724,139 | A | | 3/1903 | Smith |
| 918,213 | A | | 4/1909 | Specht |
| 946,305 | A | * | 1/1910 | Abbott ..... 49/209 |
| 966,939 | A | | 9/1910 | Mitchell |
| 982,828 | A | | 1/1911 | Kelly |

(Continued)

OTHER PUBLICATIONS

International Search Report and Written Opinion for Application No. PCT/US2010/029383, dated May 25, 2010.

(Continued)

*Primary Examiner* — Jerry Redman
(74) *Attorney, Agent, or Firm* — Nelson Mullins Riley & Scarborough LLP; Anthony A. Laurentano

(57) ABSTRACT

A combined sealing system for connecting a first panel to a frame includes a first, second, and third active sealing systems. The first active sealing system engages a sill rail of the first panel with a sill of the frame. The second active sealing system engages a meeting rail of the first panel with a meeting rail of a second panel within the frame. The third active sealing system engages a stile rail of the sash with a jamb of the frame. Upon the first panel being in a closed position relative to the frame, each of the first, second, and third active sealing systems having a locked configuration and an unlocked configuration.

15 Claims, 19 Drawing Sheets

U.S. PATENT DOCUMENTS

| | | | | | |
|---|---|---|---|---|---|
| 1,009,978 | A | * | 11/1911 | Knappe | 49/255 |
| 1,021,862 | A | * | 4/1912 | Culver | 49/320 |
| 1,170,101 | A | * | 2/1916 | Pullets | 49/417 |
| 1,178,775 | A | * | 4/1916 | Albright | 49/318 |
| 1,345,967 | A | * | 7/1920 | Smelser | 49/318 |
| 1,468,958 | A | | 9/1923 | Champion | |
| 1,489,018 | A | * | 4/1924 | Shultz | 49/174 |
| 1,675,230 | A | | 6/1928 | Snyder | |
| 1,715,188 | A | | 5/1929 | Bullock | |
| 1,716,764 | A | | 6/1929 | Carrigan | |
| 1,797,839 | A | | 3/1931 | Ramsay | |
| 1,974,269 | A | * | 9/1934 | Gonder | 52/476 |
| 1,977,726 | A | | 10/1934 | Jacobson | |
| 1,993,506 | A | | 3/1935 | Fauner | |
| 1,995,939 | A | | 3/1935 | Osten | |
| 2,065,590 | A | | 12/1936 | Jennings | |
| 2,207,065 | A | * | 7/1940 | McCormick | 49/318 |
| 2,248,719 | A | * | 7/1941 | Owen | 49/25 |
| 2,268,114 | A | * | 12/1941 | Foster et al. | 49/318 |
| 2,541,421 | A | | 2/1951 | Hunter | |
| 2,552,369 | A | | 5/1951 | Currie | |
| 2,593,093 | A | | 4/1952 | Bjork | |
| 2,628,678 | A | | 2/1953 | Webster | |
| 2,663,056 | A | | 12/1953 | Hardgrave | |
| 2,719,342 | A | | 10/1955 | Hunt | |
| 2,753,020 | A | * | 7/1956 | Ware, Jr. | 49/318 |
| 2,763,038 | A | | 9/1956 | Hagerty | |
| 2,766,860 | A | * | 10/1956 | Travis | 49/318 |
| 2,805,451 | A | * | 9/1957 | Evans et al. | 49/318 |
| 2,837,151 | A | | 6/1958 | Stroup | |
| 2,862,256 | A | | 12/1958 | Stroup | |
| 2,862,262 | A | | 12/1958 | Shea | |
| 2,928,144 | A | | 3/1960 | Persson | |
| 3,004,309 | A | | 10/1961 | Karodi | |
| 3,054,152 | A | | 9/1962 | Trammell | |
| 3,059,287 | A | | 10/1962 | Baruch | |
| 3,070,856 | A | | 1/1963 | Minick | |
| 3,077,644 | A | | 2/1963 | Kesling | |
| 3,098,519 | A | | 7/1963 | Myers | |
| 3,111,727 | A | | 11/1963 | Gerecke | |
| 3,126,051 | A | | 3/1964 | Sussin | |
| 3,161,229 | A | | 12/1964 | Sanders | |
| 3,163,891 | A | | 1/1965 | Seliger | |
| 3,184,806 | A | | 5/1965 | Bragman | |
| 3,252,255 | A | * | 5/1966 | Marpe | 49/318 |
| 3,289,377 | A | | 12/1966 | Hetman | |
| 3,295,257 | A | | 1/1967 | Douglass | |
| 3,335,524 | A | | 8/1967 | Carson | |
| 3,374,821 | A | | 3/1968 | White | |
| 3,383,801 | A | | 5/1968 | Dallaire | |
| 3,466,801 | A | | 9/1969 | Bohn | |
| 3,512,303 | A | | 5/1970 | Wright | |
| 3,590,530 | A | * | 7/1971 | Duguay | 49/161 |
| 3,590,531 | A | | 7/1971 | Childs | |
| 3,660,936 | A | | 5/1972 | Bryson | |
| 3,660,940 | A | | 5/1972 | Tavano | |
| 3,816,966 | A | | 6/1974 | Sause, Jr. | |
| 3,818,636 | A | | 6/1974 | Calais et al. | |
| 3,821,884 | A | | 7/1974 | Walsh | |
| 3,848,908 | A | | 11/1974 | Rich | |
| 3,857,199 | A | | 12/1974 | Frach et al. | |
| 3,910,155 | A | | 10/1975 | Wilson | |
| 3,959,927 | A | | 6/1976 | Good | |
| 4,018,022 | A | | 4/1977 | Fink | |
| 4,027,431 | A | | 6/1977 | Rackard | |
| 4,064,651 | A | | 12/1977 | Homs | |
| 4,128,967 | A | * | 12/1978 | Kirsch | 49/318 |
| 4,170,846 | A | | 10/1979 | Dumenil et al. | |
| 4,307,542 | A | | 12/1981 | Lense | |
| 4,317,312 | A | | 3/1982 | Heideman | |
| 4,322,914 | A | | 4/1982 | McGaughey | |
| 4,392,329 | A | | 7/1983 | Suzuki | |
| 4,413,446 | A | | 11/1983 | Dittrich | |
| 4,453,346 | A | | 6/1984 | Powell et al. | |
| 4,479,330 | A | | 10/1984 | Muller | |
| 4,496,942 | A | | 1/1985 | Matsuoka | |
| 4,535,563 | A | | 8/1985 | Mesnel | |
| 4,614,060 | A | | 9/1986 | Dumenil et al. | |
| 4,643,239 | A | | 2/1987 | Wentzel | |
| 4,656,779 | A | * | 4/1987 | Fedeli | 49/318 |
| 4,656,799 | A | | 4/1987 | Maryon | |
| 4,716,693 | A | | 1/1988 | Webster | |
| 4,765,105 | A | | 8/1988 | Tissington et al. | |
| 4,768,316 | A | | 9/1988 | Haas | |
| 4,831,509 | A | | 5/1989 | Jones et al. | |
| 4,837,560 | A | | 6/1989 | Newberry | |
| 4,870,909 | A | | 10/1989 | Richter | |
| 4,936,049 | A | | 6/1990 | Hansen | |
| 5,007,202 | A | | 4/1991 | Guillon | |
| 5,020,292 | A | | 6/1991 | Strom et al. | |
| 5,029,911 | A | | 7/1991 | Daniels | |
| 5,030,488 | A | | 7/1991 | Sobolev | |
| 5,187,867 | A | | 2/1993 | Rawlings | |
| 5,293,726 | A | | 3/1994 | Schick | |
| 5,327,684 | A | | 7/1994 | Herbst | |
| 5,339,881 | A | | 8/1994 | Owens | |
| 5,349,782 | A | | 9/1994 | Yulkowski | |
| 5,379,518 | A | | 1/1995 | Hopper | |
| 5,446,997 | A | | 9/1995 | Simonton | |
| 5,467,559 | A | | 11/1995 | Owens | |
| 5,479,151 | A | | 12/1995 | Lavelle et al. | |
| 5,511,833 | A | | 4/1996 | Tashman et al. | |
| 5,521,585 | A | | 5/1996 | Hamilton | |
| 5,522,180 | A | | 6/1996 | Adler et al. | |
| 5,522,195 | A | | 6/1996 | Bargen | |
| 5,569,878 | A | | 10/1996 | Zielinski | |
| 5,584,142 | A | | 12/1996 | Spiess | |
| 5,605,013 | A | | 2/1997 | Hogston | |
| 5,638,639 | A | | 6/1997 | Goodman et al. | |
| 5,784,834 | A | | 7/1998 | Stutzman | |
| 5,786,547 | A | * | 7/1998 | Zielinski | 174/375 |
| 5,848,630 | A | | 12/1998 | Manzo | |
| 5,870,859 | A | | 2/1999 | Kitada | |
| 5,870,869 | A | | 2/1999 | Schrader | |
| 5,964,060 | A | | 10/1999 | Furlong | |
| 6,041,552 | A | | 3/2000 | Lindahl | |
| 6,057,658 | A | | 5/2000 | Kovach et al. | |
| 6,061,967 | A | | 5/2000 | Judds | |
| 6,082,047 | A | | 7/2000 | Comaglio et al. | |
| 6,105,313 | A | | 8/2000 | Holloway et al. | |
| 6,112,466 | A | | 9/2000 | Smith et al. | |
| 6,112,467 | A | | 9/2000 | Bark et al. | |
| 6,112,496 | A | | 9/2000 | Hugus et al. | |
| 6,119,307 | A | | 9/2000 | Weishar et al. | |
| 6,170,195 | B1 | | 1/2001 | Lim | |
| 6,173,533 | B1 | | 1/2001 | Cittadini et al. | |
| 6,181,089 | B1 | | 1/2001 | Kovach et al. | |
| 6,202,353 | B1 | | 3/2001 | Giacomelli | |
| 6,218,939 | B1 | | 4/2001 | Peper | |
| 6,243,999 | B1 | | 6/2001 | Silverman | |
| 6,289,643 | B1 | | 9/2001 | Bonar | |
| 6,318,037 | B1 | | 11/2001 | Hansen | |
| 6,442,899 | B1 | | 9/2002 | Gledhill | |
| 6,490,832 | B1 | | 12/2002 | Fischbach et al. | |
| D470,252 | S | | 2/2003 | Castrey | |
| 6,546,682 | B1 | | 4/2003 | DeBlock et al. | |
| 6,553,735 | B1 | | 4/2003 | Wang Chen | |
| 6,568,131 | B1 | | 5/2003 | Milano, Jr. | |
| 6,619,005 | B1 | | 9/2003 | Chen | |
| 6,644,884 | B2 | | 11/2003 | Gledhill | |
| 6,651,389 | B2 | | 11/2003 | Minter et al. | |
| 6,772,818 | B2 | | 8/2004 | Whitley et al. | |
| 6,786,005 | B1 | | 9/2004 | Williams | |
| 6,871,902 | B2 | | 3/2005 | Carson et al. | |
| 6,973,753 | B2 | | 12/2005 | Liebscher | |
| 7,010,888 | B2 | | 3/2006 | Tumlin et al. | |
| 7,124,538 | B1 | | 10/2006 | Kline | |
| 7,145,436 | B2 | | 12/2006 | Ichikawa et al. | |
| 7,185,468 | B2 | | 3/2007 | Clark et al. | |
| 7,487,616 | B2 | | 2/2009 | Deaver | |
| 7,566,035 | B2 | | 7/2009 | Bonshor | |
| 7,624,539 | B2 | * | 12/2009 | Speyer et al. | 49/484.1 |
| 7,627,987 | B2 | * | 12/2009 | Thielmann et al. | 49/320 |
| 7,665,245 | B2 | * | 2/2010 | Speyer et al. | 49/320 |
| 7,685,774 | B2 | * | 3/2010 | Thielmann | 49/411 |
| 7,685,775 | B2 | * | 3/2010 | Speyer et al. | 49/411 |
| 7,685,776 | B2 | * | 3/2010 | Speyer et al. | 49/411 |

| | | | | |
|---|---|---|---|---|
| 7,707,773 | B2 * | 5/2010 | Thielmann et al. | 49/321 |
| 7,719,213 | B2 | 5/2010 | Herman et al. | |
| 2003/0033786 | A1 | 2/2003 | Yulkowski | |
| 2004/0068935 | A1 | 4/2004 | Ichikawa et al. | |
| 2004/0194386 | A1 | 10/2004 | Albiero | |
| 2005/0097842 | A1 | 5/2005 | Arcamonte et al. | |
| 2005/0102908 | A1 | 5/2005 | Martin | |
| 2006/0207199 | A1 | 9/2006 | Darnell | |
| 2007/0289221 | A1 | 12/2007 | Speyer et al. | |
| 2009/0151259 | A1 * | 6/2009 | Speyer et al. | 49/306 |
| 2009/0165415 | A1 | 7/2009 | Salerno | |
| 2009/0165423 | A1 | 7/2009 | Salerno | |
| 2010/0077665 | A1 * | 4/2010 | Speyer et al. | 49/304 |

OTHER PUBLICATIONS

Dictionary.com, "Active," retrieved online at: http://dictionary.reference.com/browse/active (2010).

Patio Life—Operation, retrieved online at: http://www.rotohardware.com/Products/Patio%20Life/PL-Operation.htm (2006).

International Search Report for Application No. PCT/US2010/029383, dated May 25, 2010.

International Search Report for Application No. PCT/US2010/029206, dated Jun. 2, 2010.

* cited by examiner

ACTIVE SEALING SYSTEM FOR SINGLE-HUNG DOOR/WINDOW

CROSS-REFERENCE TO RELATED APPLICATIONS

This application is a Continuation-In-Part of Ser. No. 11/322,952, now U.S. Pat. No. 7,685,775, filed on Dec. 30, 2005 and issued on Mar. 30, 2010; and a Continuation-In-Part of U.S. application Ser. No. 11/756,957, filed Jun. 1, 2007, now pending, which is a Continuation-In-Part of Ser. No. 11/425,377, filed Jun. 20, 2006, now U.S. Pat. No. 7,624,539 issued on Dec. 1, 2009, all of which are incorporated herein by reference in their entirety.

BACKGROUND OF THE INVENTION

1. Field of the Invention

The disclosure relates generally to sealing systems for use with panels, such as a door or a window, within a frame and, more specifically, to an active sealing system for providing an improved seal between a panel and frame.

2. Description of the Related Art

Certain types of panels, such as doors and windows, are positioned within openings of a wall and/or other structures using a frame. These panels may also open and close by pivoting relative to the frame. Alternatively, the one or more panel may slide relative to the frame. An issue associated with these types of panels is the integrity of the seals between the panels and the frame. In many instances, these seals are an insufficient barrier in preventing the transfer of such environmental elements as noise, weather, water, and insects from one side of the panel to the other side of the panel.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal, since, in many instances, the integrity of the seal relies upon these members having certain positional relationships relative to one another.

Another issue associated with the movement of one or more panels relative to the frame is structural integrity and/or security of the panels relative to the frame. While in certain circumstances, allowing the panel to move relative to the frame is desirable, in other circumstances, not allowing the panel to move relative to the frame is desirable for the purpose of preventing undesired access through the panel. Means for providing these separate functionalities, however, can be incompatible with one another, and the means employed to provide both functions often involve tradeoffs that reduce the effectiveness of both functions.

There is, therefore, also a need for a sealing system that effectively allows both a panel to move relative to the frame and also to selectively prevent movement of the panel relative to the frame. There is also a need for a sealing system that can be employed between a frame and panel that prevents the transfer from one side of the panel to the other side of the panel such environmental effects as noise, weather, water, heat/cold, and insects.

BRIEF SUMMARY OF THE INVENTION

Embodiments of the invention address deficiencies of the art with respect to effectively creating a seal between a panel and a frame. In this regard, a combined sealing system for connecting a first panel to a frame includes first, second, and third active sealing systems. The first active sealing system engages a sill rail of the first panel with a sill of the frame. The second active sealing system engages a meeting rail of the first panel with a meeting rail of a second panel within the frame. The third active sealing system engages a stile rail of the sash with a jamb of the frame. Upon the first panel being in a closed position relative to the frame, each of the first, second, and third active sealing systems having a locked configuration and an unlocked configuration.

In another aspect, a sealing system for connecting a panel to the frame is disclosed with the panel movable relative to a frame in a first direction towards a single closed position. The active sealing system includes a movable member pivoting between an engaged position and an unengaged position. Upon the panel being in a single closed position relative to the frame, the active sealing system has a locked configuration and an unlocked configuration, and the active seal is created between the first surface of the panel and the first surface of the frame only in the locked configuration of the active sealing system. In the locked configuration and while the panel is stationary relative to the frame, the movable member in the engaged position prevents movement of the panel in a second direction opposite to the first direction.

In other aspects, a drive member engages the movable member, and the engagement of the drive member with the movable member pivots the movable member from the unengaged position to the engaged position. The frame includes a lip, and the movable member pivots about the lip. The movable member can float freely between the lip and the drive member. The movable member includes a tip, a tail, the neck is positioned between the tip and the tail, and the neck is positioned between the lip and the drive member. A greatest distance between closest portions of the drive member and the lip is smaller than a width of the tail and a width of the tip. The panel includes a recess into which the movable member extends, and the recess includes an inwardly-extending nook. The inwardly-extending nook includes the first surface of the panel, and in the engaged position, the movable member positioned within the inwardly-extending nook and against the first surface of the panel.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
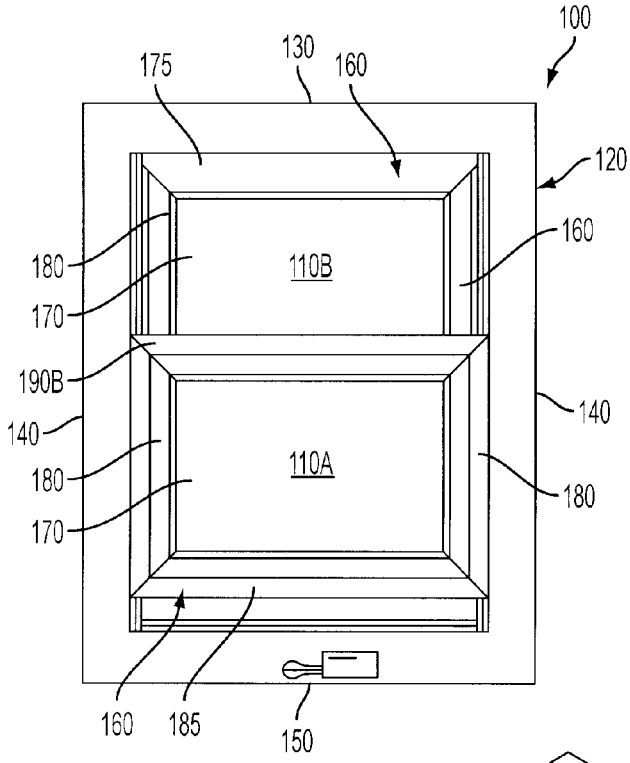
FIG. 1 is a front view of a door/window system in a closed and partially-closed position in accordance with the inventive arrangements.
Figure 2:
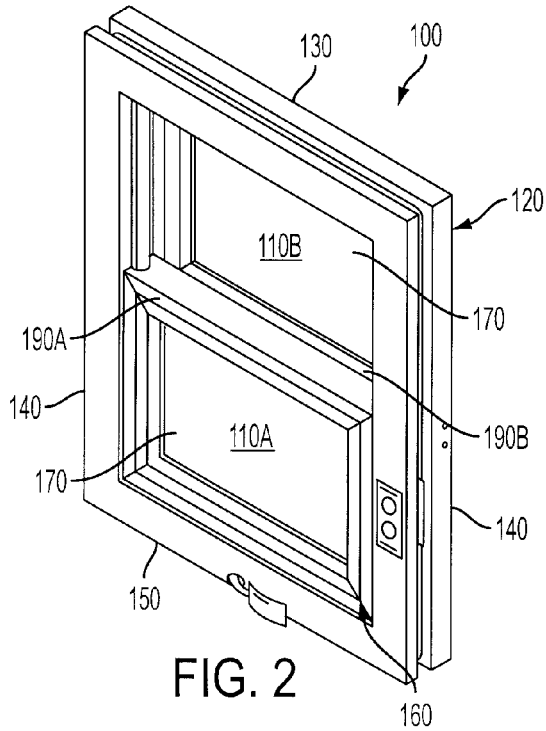
FIG. 2 is a perspective view of a door/window system in a closed position and including an electro-mechanical lock in accordance with the inventive arrangements.
Figure 3A:
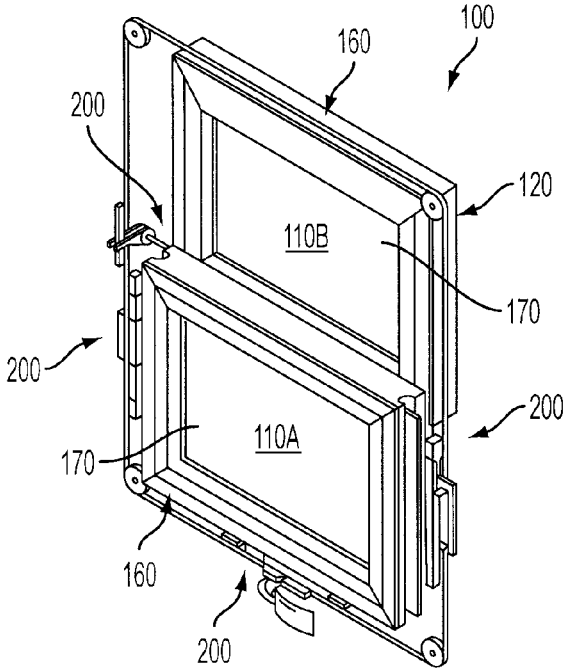
FIGS. 3A-3B are perspective, revealed views of a door/window system in a closed position and respectively including a mechanical lock and both a mechanical and electro-mechanical lock in accordance with the inventive arrangements.
Figure 3B:
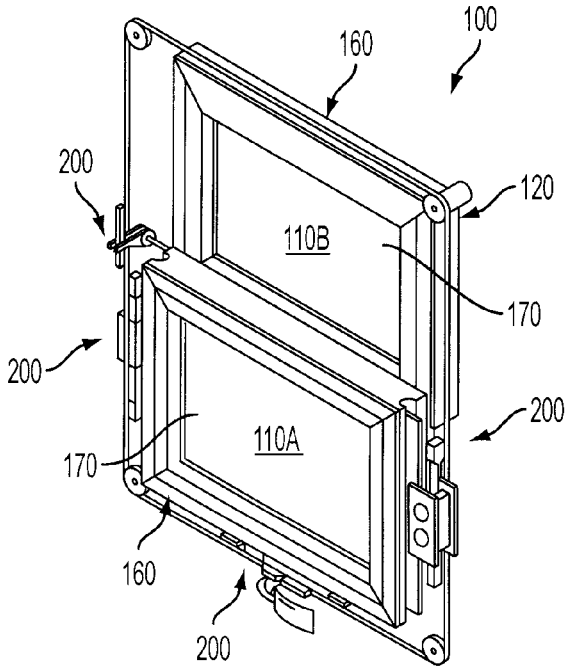
Figure 4A:
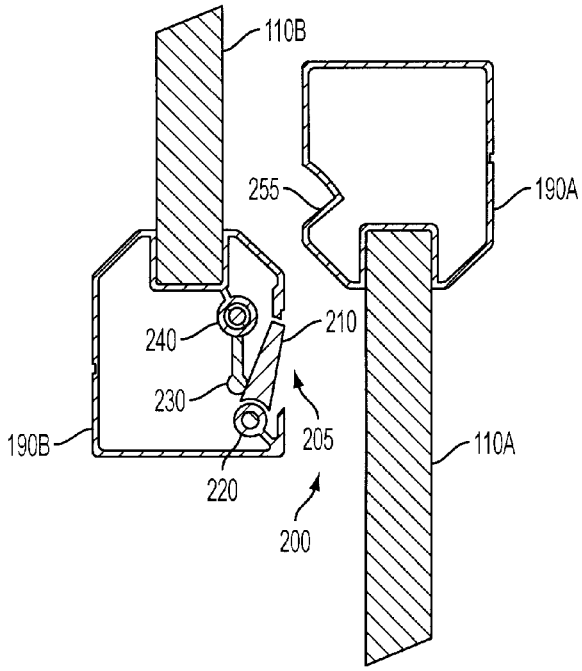
FIGS. 4A-4D are cross-sectional views of a sealing system positioned in meeting rails of the door/window system, respectively, in the open, closed and unlocked, partially locked, and locked configurations, in accordance with the inventive arrangements.
Figure 4B:
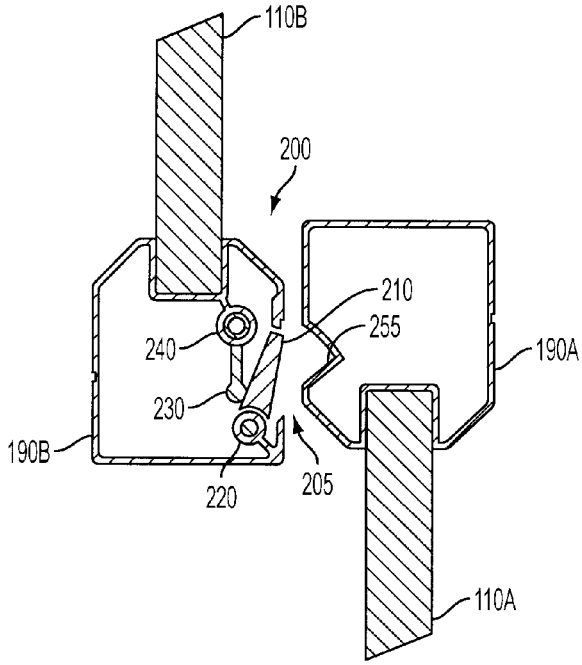
Figure 4C:
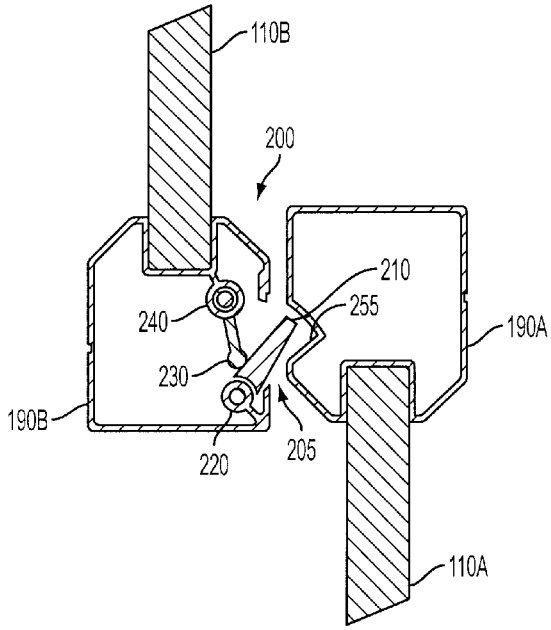
Figure 4D:
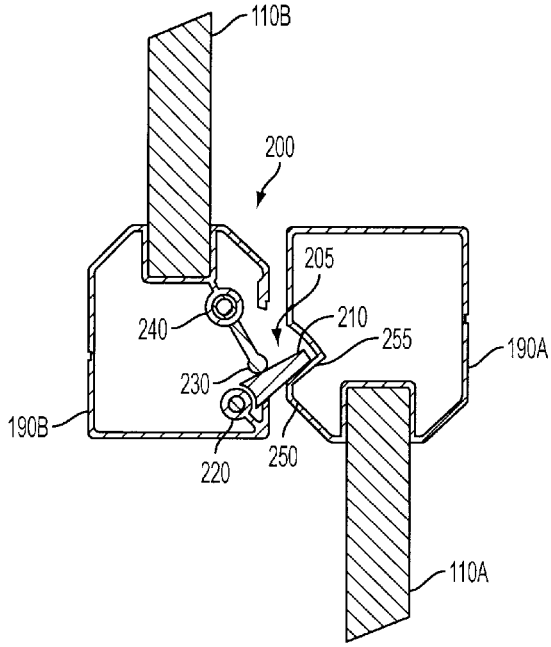

FIGS. 1 and 2 illustrate an exemplar door/window system 100 for use with an improved sealing system 200 and combination of sealing systems 200. The sealing system 200 can be used with many types of doors and/or windows, and the sealing system 200 is not limited to the particular door/window system 100 illustrated. For example, the sealing system 200 may be used with pocket doors, sliding doors, French doors, entry doors, garage doors, sliding windows, single-hung windows, double-hung windows, casement windows, and awning windows. The door/window system 100 includes at least one panel 110A, 110B connected to and movable relative to a stationary frame 120.

The door/window system 100 is not limited in the manner in which the panel 110A, 110B moves relative to the frame 120. For example, the panels 110A, 110B may pivot relative to the frame 120. In certain aspects of the door/window system 100, however, either one or both of the panels 110A, 110B may move relative to the frame 120 along a plane parallel to a longitudinal axis of one of the surfaces (e.g., the header 130, jambs 140, or sill 150) of the frame 120 and/or substantially along a plane defined by the panel 110A, 110B. In still further aspects of the door/window system 100, one or more of the panels 110A, 110B can move relative to the frame 120 in multiple manners (e.g., pivoting relative to the frame 120 and sliding relative to the frame 120).

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

Each panel 110 may include a sash 160 that surrounds a pane 170. The pane 170 is not limited as to a particular material. For example, the pane 170 may be translucent, such as glass or plastic, opaque, such as with wood or metal, or any combination thereof. The sash may include a header rail 175, jamb or stile rails 180, and a sill rail 185. As recognized by those skilled in the art, different terms may also be associated with the structure identified as the header rail 175, the jamb or stile rail 180, and sill rail 185. The respective rails of the panels 110A, 110B that adjoin one another when the door/window system 100 is closed are also known as meeting rails 190A, 190B.

The sealing system 200 (see FIGS. 4A-4D, 5A-5C, 6A-6D) may be used with each of the members 175, 180, 185, 190 of the sash 160 to form a seal between each pair of adjacent surfaces of the sash 160 of the panel and the frame 120 or between adjacent surfaces of the meeting rail 190A of one panel 110A and the meeting rail 190B of another panel 110B. In this manner each of the separate sides of the panels 110A, 110B may employ the sealing system 200. As will be described in more detail below, not only does the sealing system 200 provide at least one seal between adjacent members of sash 160 and frame 120 or between adjacent meeting rails 190A, 190B, each of the sealing systems 200 may prevent the movement of the panels 110A, 110B relative to the frame 120. In so doing, the sealing systems 200 can act as a lock and/or security device that prevents the forced opening of the panels 110A, 110B relative to the frame 120. Many types of sealing systems 200 so capable are known in the art, and the present door/window system 100 is not limited as to a particular type of sealing system 200. In addition, the present door/window system 100 may employ one or more different types of sealing systems 200.

Additionally, although the present door/window system 100 is described herein with particular types of sealing systems 200 being positioned in particular locations, the door/window system 100 is not limited as to a particular type of sealing system 200 or a particular location of the sealing system 200. For example, a sealing system 200 may be positioned within the frame 120 and/or the sash 160.

To prevent the forced opening of the panels 110A, 110B, the sealing systems 200 are not limited as to a percentage of coverage between particular members of the frame 120 and/or panels 110A, 110B. For example, the sealing systems 200 may only cover a fractional number (e.g., 10%, 50%, 85%) of the length between particular members of the frame 120 and/or panels 110A, 110B. However, in certain aspects, the sealing systems 200 provide substantially complete coverage between the sash 160 of a panel 110A, 110B and the frame 120 or between the meeting rail 190A of one panel 110A and the meeting rail 190B of another panel 110B. In so doing, the combined sealing systems 200 can provide a seal substantially completely around one or both of the panels 110A, 110B.

Top Sealing Mechanism

Referring to FIGS. 4A-4D, a sealing system 200 for use in the door/window system 100 is illustrated. Upon the panel 110A being disposed in the closed position (e.g., FIGS. 4B-4D), the sealing system 200 includes an active seal 205 having a locked configuration and an unlocked configuration while the panel 110A is disposed in the closed position.

The active seal 205 operates by having a movable member 210, disposed in one of the meeting rails 190A, 190B of the first or second panels 110A, 110B, engage a stationary or movable portion of the other of the sashes 160. Thus, a movable member 210 may be positioned in either the meeting rail 190A of the first panel 110A or the meeting rail 190B of the second panel 120B. However, in certain aspects of the sealing system 200, as illustrated, the movable member 210 is positioned in the meeting rail 190B of the second panel 110B and engages a stationary face 255 on the meeting rail 190A of the first panel 110A.

In certain aspects of the sealing system 200, the active seal 205 can create a seal 250 between the movable member 210 and the opposing face 255. The movable member 210 and/or opposing face 255 may include passive seals (not shown) on one or both surfaces. The active seal 205 is not limited in the manner by which the movable member 210 engages the opposing face 255. For example, the movable member 210 may operate as a linearly-traveling piston. However, in certain aspects of the active seal 205, the movable member 210 (hereinafter referred to as seal gate 210) pivots about a seal pivot 220. The manner in which the seal gate 210 itself is driven in not limited. For example, the seal gate 210 may be directly driven, for example, at the seal pivot 220. Alternatively, in certain aspects of the active seal, the seal gate 210 is driven using a drive gate 230 that causes the seal gate 210 to rotate about the seal pivot 220.

Although not limited in this manner, the drive gate 230 pivots about a drive pivot 240 and is itself driven by a drive system 300 (see discussion with regard to FIGS. 12A-12C and 13A-13C). By using leverage generated by these inter-engaging levers 210, 230, the active seal 205 is capable of exerting significant force against the meeting rail 190A or 190B. In so doing, a seal 250 between the movable member 210 and the opposing face 255 can be created and/or enhanced. Additionally, the active seal 205 can prevent movement of the first panel 110A relative to the second panel 110B or the frame 120. For example, referring to FIG. 4D (i.e., the closed and locked position of the first panel 110A and sealing system 200), the drive gate 230 engaging the seal gate 210 prevents upward movement of the lower panel 110A relative to upper panel 110B.

Side Active Sealing Mechanisms

Figure 5A:
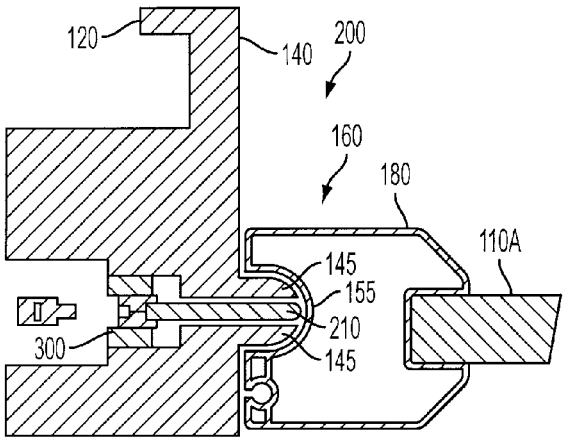
FIGS. 5A-5C are cross-sectional views of a sealing system positioned in a jamb and sash of the door/window system, respectively, in the closed and unlocked, partially locked, and locked configurations, in accordance with the inventive arrangements.
Figure 5B:
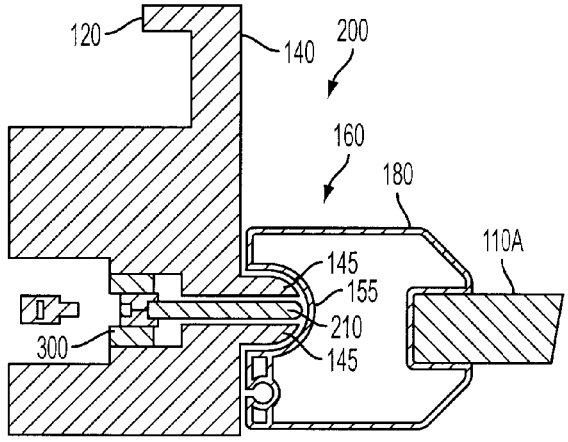
Figure 5C:
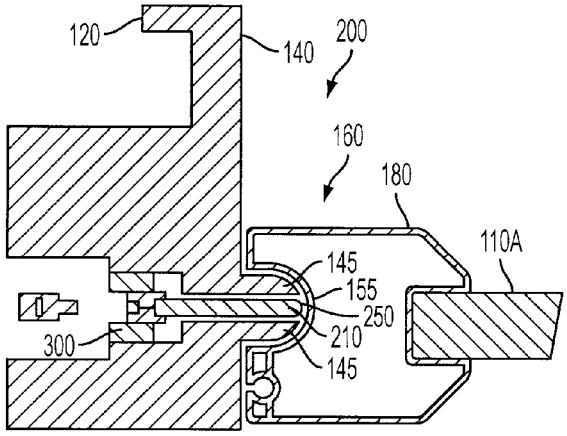
Figure 6A:
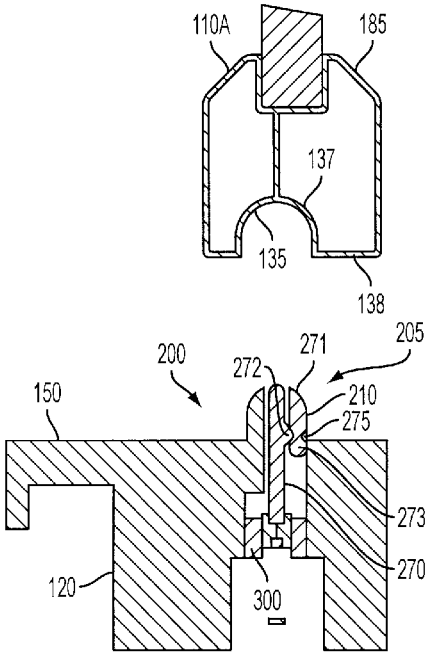
FIGS. 6A-6D are cross-sectional views of a sealing system positioned in a sill and sash of the door/window system, respectively, in the open, closed and unlocked, partially locked, and locked configurations, in accordance with the inventive arrangements.
Figure 6B:
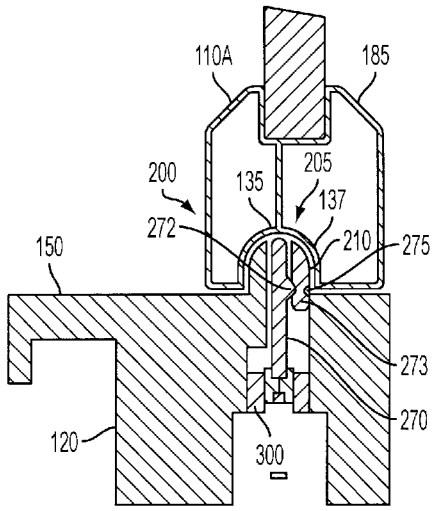
Figure 6C:
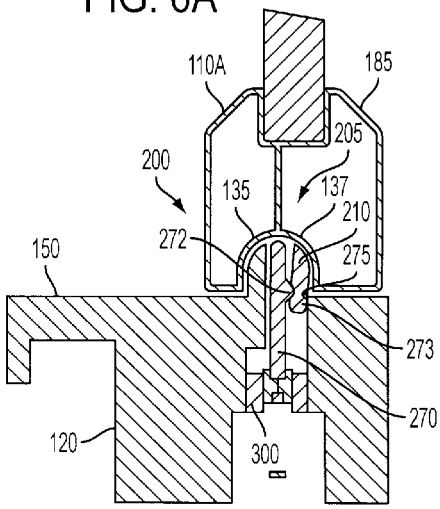
Figure 6D:
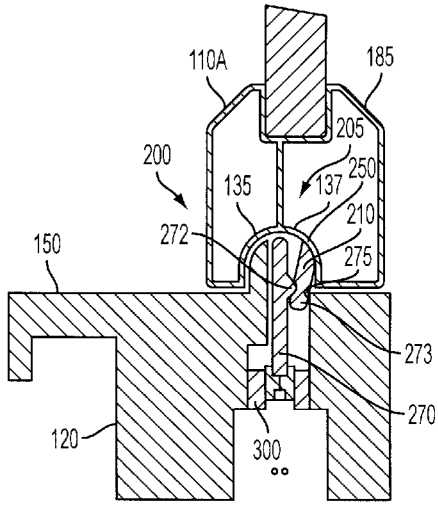

Referring to FIGS. 5A-5C, another configuration of a sealing system 200 for use in the door/window system 100 is illustrated. Upon the panel 110A being disposed in the closed position (e.g., FIGS. 5A-5C), the sealing system 200 also includes a movable member 210 that is driven by a drive system 300 from a first, unlocked position to a first, locked position to form a seal 250 between, for example, adjacent members of sash 160 and the frame 120.

In certain aspects of the sealing system 200, the seal 250 is formed by engagement of the movable member 210 positioned on one of the frame 120 and sash 160 with another feature positioned on the other of the frame 120 and sash 160. However, in certain aspects of the sealing system 200, the movable member 210 is disposed in the frame 120 and engages a portion of the sash 160 of the panel 110A.

Although not limited in this manner, the sealing system 200 may be positioned within jambs 140 of the frame 120, and the movable member 210 is variably extendable through a guide shoulder 145. The guide shoulder 145 extends into a channel 155 of the sash 160 and acts as a guide for the panel 110A as the panel 110A is moved within the frame 120. In extending through the guide shoulder 145, the movable member 210 may engage an inner surface of the channel 155 to form a seal 250 between the movable member 210 within the frame 120 and the sash 160.

Bottom Active Sealing Mechanism

Referring to FIGS. 6A-6D, yet another configuration of a sealing system 200 for use in the door/window system 100 is illustrated. Upon the panel 1 OA being disposed in the closed position (e.g., FIGS. 6B-6D), the sealing system 200 includes an active seal 205 having a locked configuration and an unlocked configuration while the panel 110A is disposed in the closed position. Although illustrated as creating an active seal between the panel 110A and frame 120, the illustrated sealing system 200 is not limited in this manner. For example, the sealing system 200 may be used to create an active seal between other portions of the door/window system 100, such as between the panels 110A, 110B.

The active seal 205 operates by having a movable member disposed in the sill 150 of the frame 120 engage a stationary or movable portion of the sill rail 185 of the first panel 110 or vice-versa. Thus, a movable member 210 may be positioned in either the sill 150 of the frame 120 or the sill rail 185 of the first panel 110A. However, in certain aspects of the sealing system 200, as illustrated, the movable member 210 is positioned in the sill 150 of the frame 120 and engages an inner surface of a recess 135 in the sill rail 185 of the first panel 110A.

The recess 135 can be configured to include an inwardly-extending nook 137 and a complementing outwardly-extending shoulder 138, and the movable member 210 includes a tip 271 and a tail 273. As a drive member 270 positioned against the movable member 210 extends upward, the movable member 210 rotates about a lip 275 of the sill 150. Upon the movable member 210 being positioned within the recess 135 and the drive member 270 engaging the movable member 210, the tip 271 of the movable member 210 is driven into the nook 137 (see FIG. 6D).

The movable member 210, as illustrated, is shown to be floating (i.e., not positively connected) between the drive member 270 and the lip 275 of the sill 150. Alternatively, the movable member 210 may have a positive connection via, for example, a hinge, between either the drive member 270 or the sill 150. Although the movable member 210 floats between the drive member 270 and the lip 275, the movable member 210 is prevented from being removed by being passively attached to the drive member 270 and lip 275 at a neck between the tail 273 and the tip 271 of the movable member 210. The greatest distance between closest portions of the drive member 270 and the lip 275 along any position during the drive members 270 movement is smaller than either the width of the tail 273 or the tip 271. In this manner, the movable member 210 is prevented from being removed despite floating within the sealing system 200.

Figure 9A:
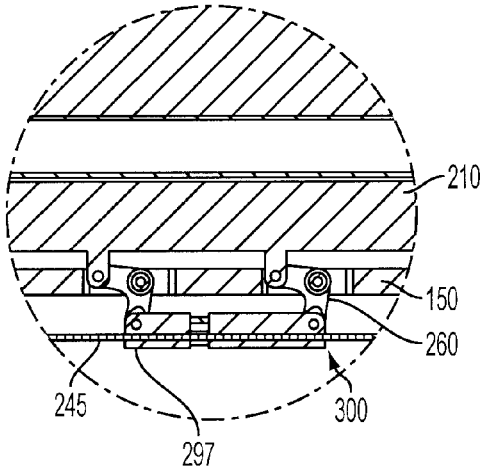
FIGS. 9A-9C are cross-sectional views of a drive system positioned in a sill of the door/window system, respectively, in the closed and unlocked, partially locked, and locked configurations, in accordance with the inventive arrangements.
Figure 10A:
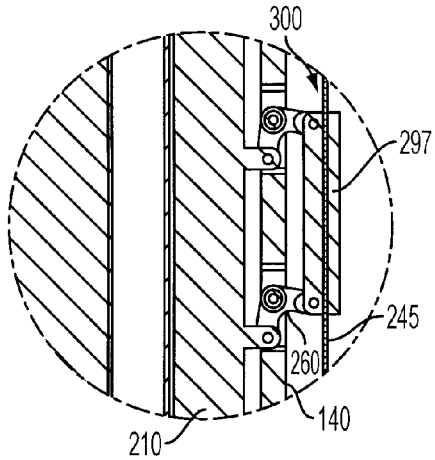
FIGS. 10A-10C are cross-sectional views of a drive system positioned in a jamb of the door/window system, respectively, in the closed and unlocked, partially locked, and locked configurations, in accordance with the inventive arrangements.
Figure 9B:
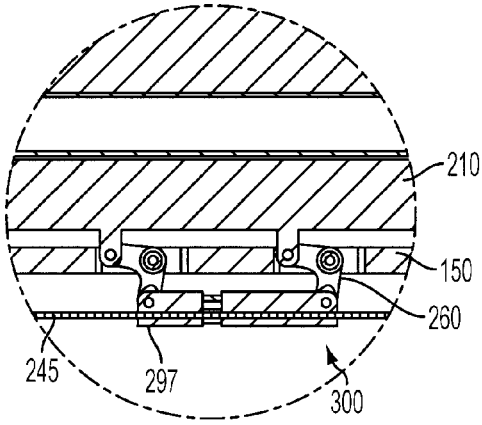
Figure 10B:
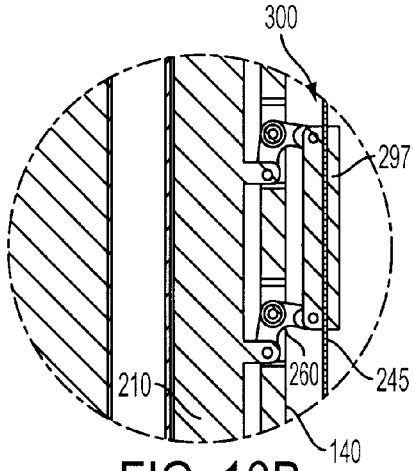
Figure 9C:
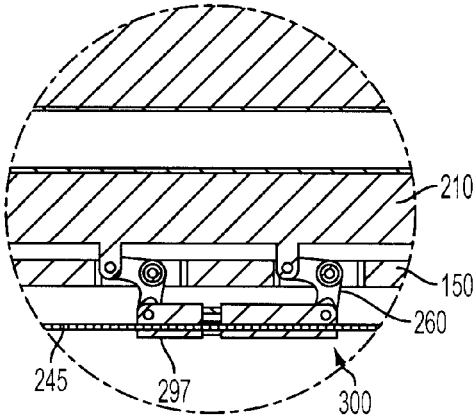
Figure 10C:
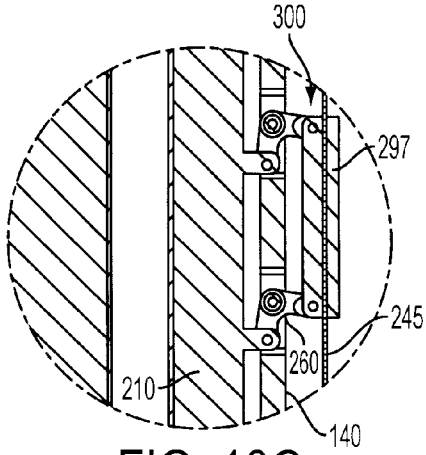
Figure 11A:
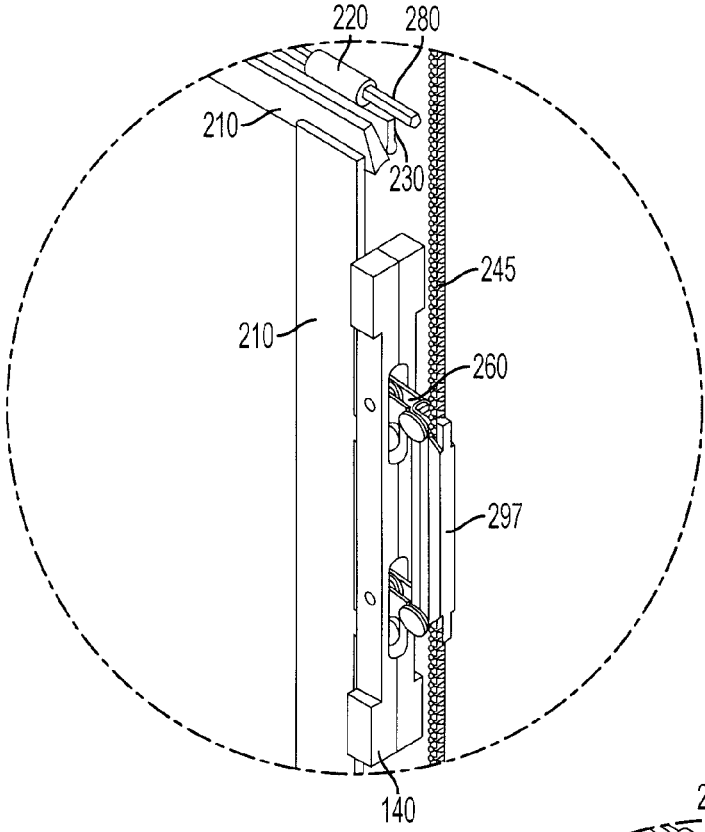
FIGS. 11A-11C are perspective views of the drive system positioned in the jamb of the door/window system, respectively, in the closed and unlocked, partially locked, and locked configurations, in accordance with the inventive arrangements.
Figure 11B:
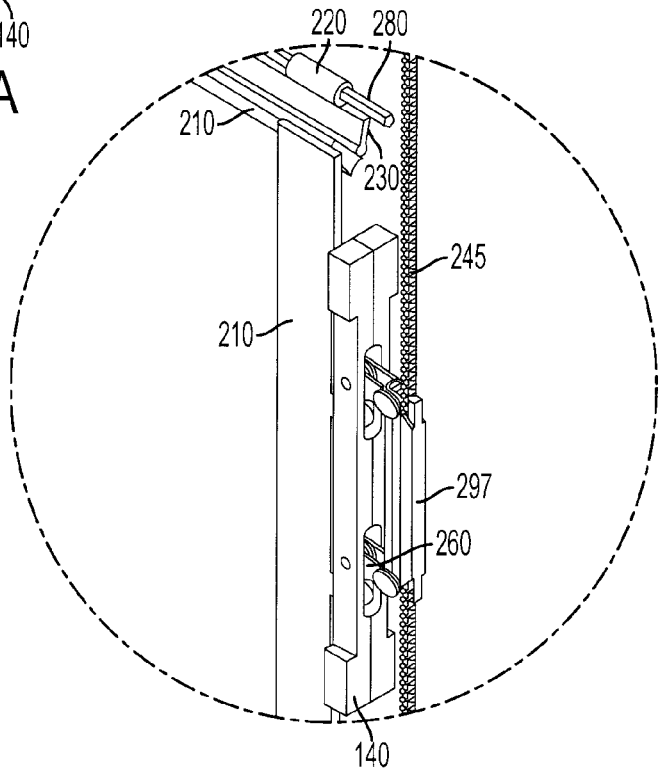
Figure 11C:
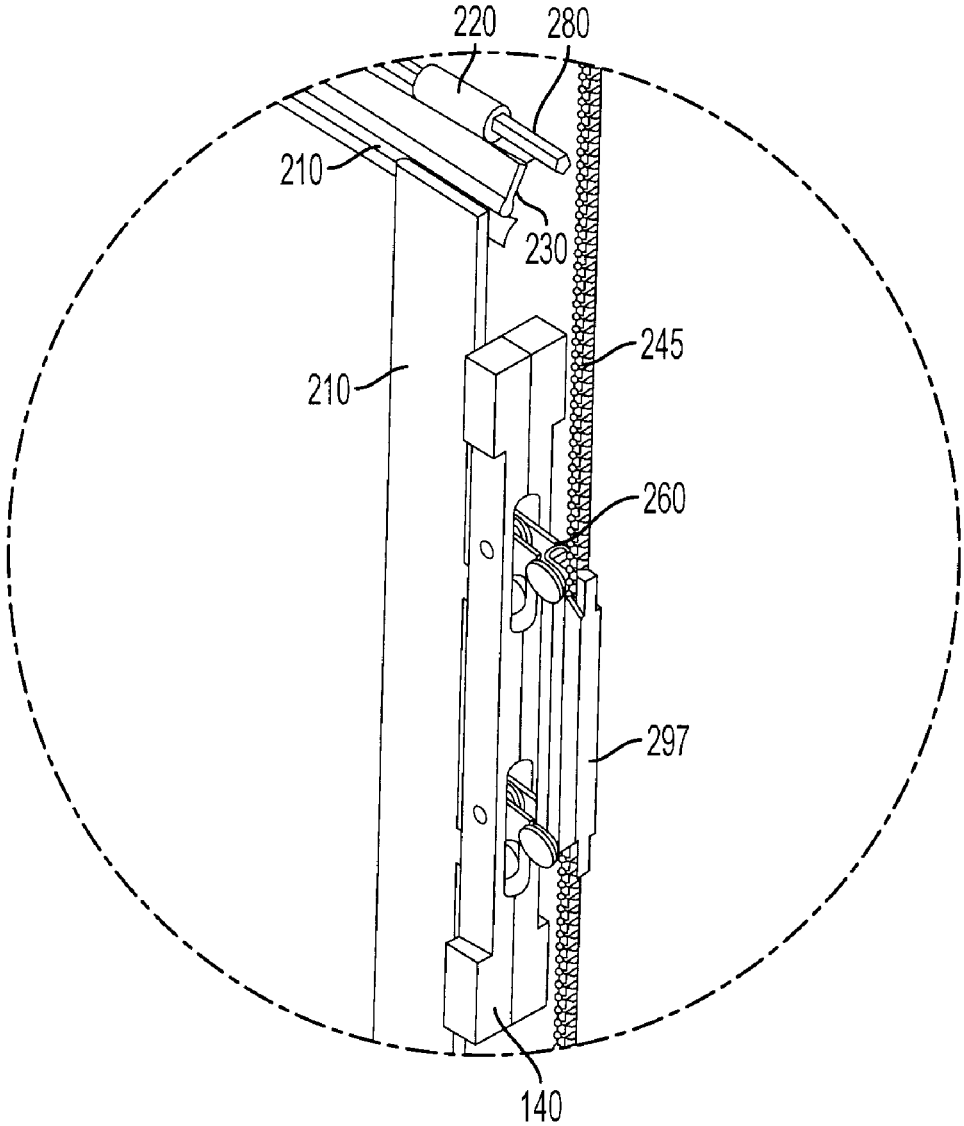
Figure 12B:
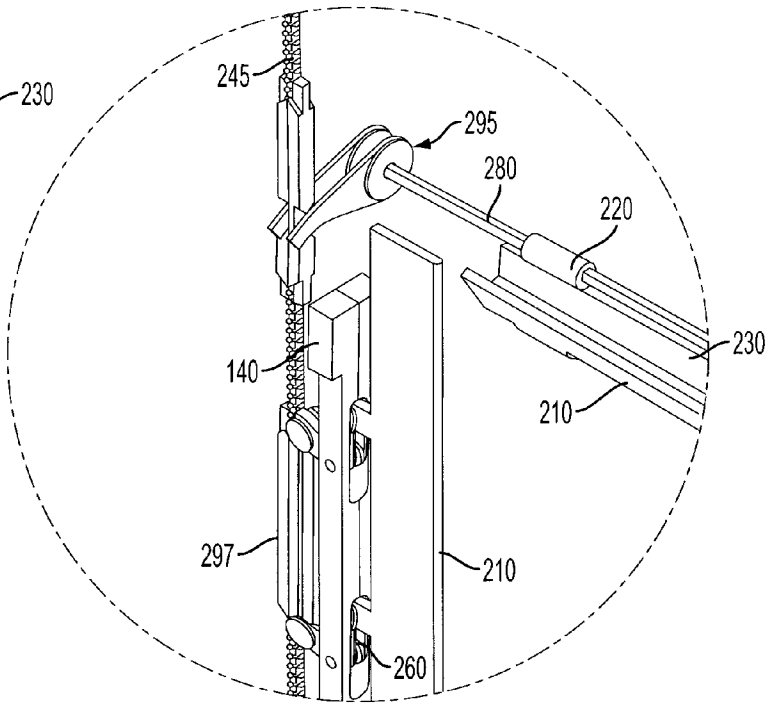
FIGS. 12A-12C are perspective views of the drive system positioned in the jamb, the drive system positioned within the meeting rail, and a transfer system connecting these drive systems, respectively, in the closed and unlocked, partially locked, and locked configurations, in accordance with the inventive arrangements.
Figure 12A:
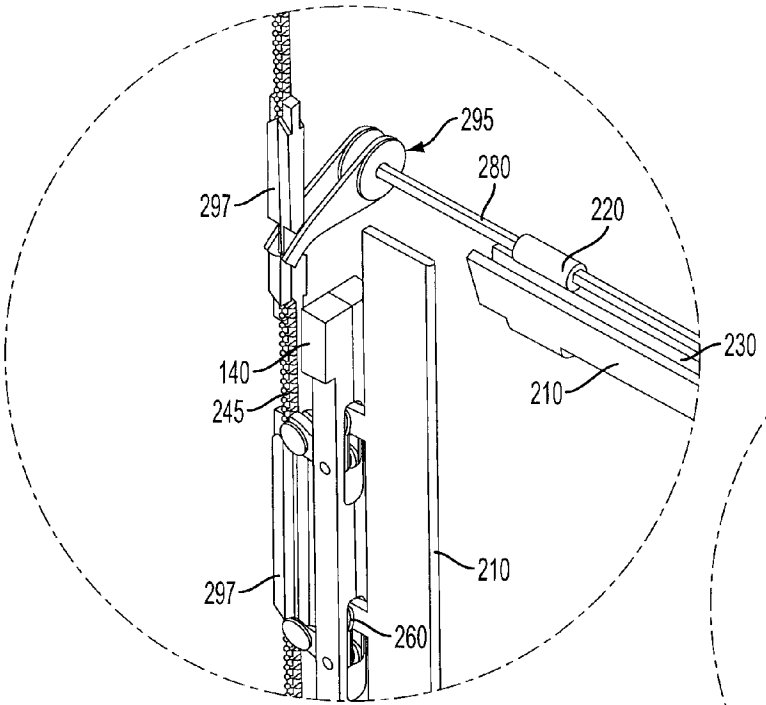
Figure 12C:
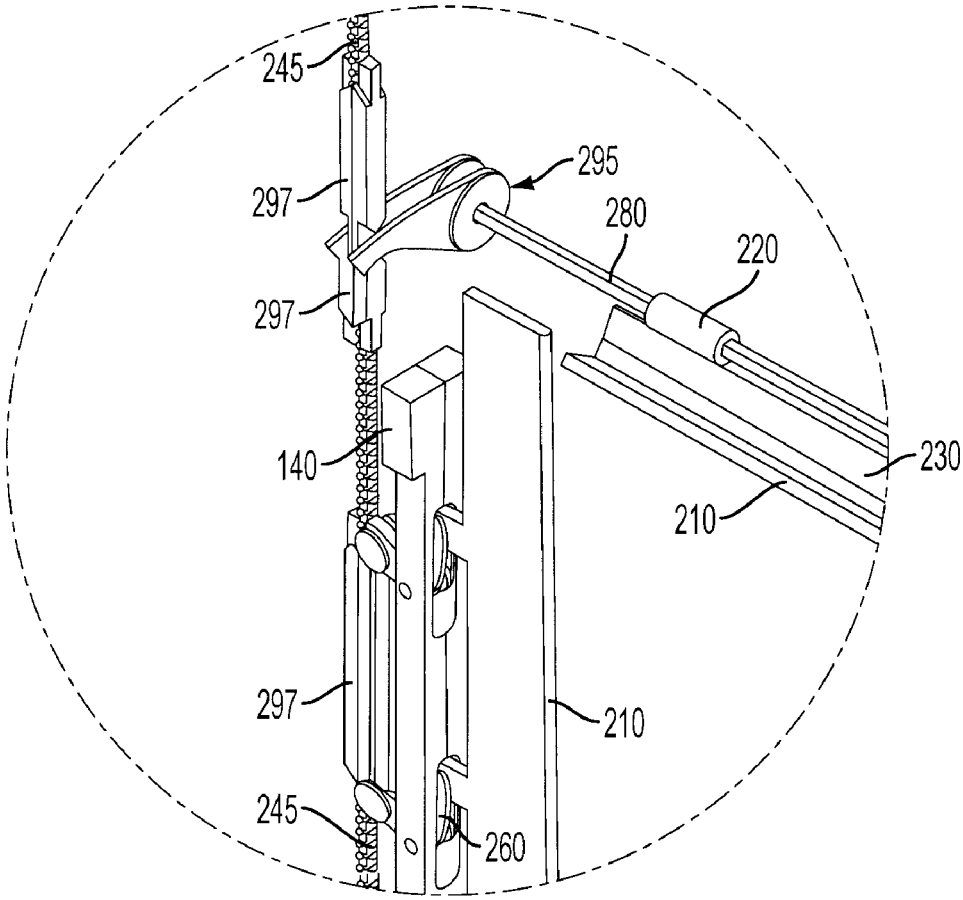

Although not limited in this manner, the drive member 270 is itself driven by a drive system 300 (see discussion with regard to FIGS. 9A-9C). By using leverage generated by the inter-engaging drive member 270 and movable member 210, the active seal 205 is capable of exerting significant force against the sill rail 185. In so doing, a seal 250 between the movable member 210 and the nook 137 can be created and/or enhanced. Additionally, the active seal 205 can prevent movement of the first panel 110A relative to sill 150. For example, since the tip 271 of the movable member 210 is driven into the nook 137, the tip 271 prevents upward movement of the outwardly-extending shoulder 138.

Seal Drive Mechanisms

Referring to FIGS. 7, 8A-8B, 9A-9C, 10A-10C, 11A-11C, 12A-12C, 13A-13C, a drive system 300 for use in the door/window system 100 is illustrated. The drive system 300 moves the sealing system 200 from the unlocked configuration (e.g., FIGS. 4A-4B, 5A, 6A-6B) to a locked configuration (e.g., FIGS. 4D, 5C, 6D). The drive system 300 may also move the sealing system 200 from the locked configuration to the unlocked configuration. In certain aspects, the drive systems 300 are configured to simultaneously move each of the separate sealing systems 200. In other aspects of the door/window system 100, however, multiple drive systems 300 may be provided to separately close one or multiple sealing systems 200.

How the drive system 300 moves the sealing system 200 from the unlocked configuration to the locked configuration (and back again) is not limited as to a particular manner and/or device. As can be readily envisioned, the configuration and operation of the drive system 300 may be determined by the configuration and operation of the sealing systems 200. Referring to FIGS. 14 and 15A-15C, the illustrated drive system 300 is shown as being driven with a manual device 400. However, other devices capable of driving a sealing system 200 are commonly known, such as a pneumatic, hydraulic, magnetic, mechanical, and electro-mechanical devices. A combination of these devices may also be used. For example, referring to FIGS. 15A-15C and FIGS. 16-18, an electro-mechanical system is shown.

Referring to FIGS. 9A-9C, 10A-10C, 11A-11C, 12A-12C, the sealing systems 200 within the jambs 140 and sill 150 are not limited in the manner in which the respective movable members 210 are driven from the first position to the second position and back again. Many types of drive systems 300 are known that are capable of transferring movement from one member to another member and the sealing system 200 is not limited in a device so capable. However, in certain aspects of the sealing system 200, the movement of the movable member 210 is driven by with a drive system 300 that transfer back and forth motion of an actuator 245 that extends along a length of the sealing system 200.

A transfer device transfers the back and forth motion of the actuator 245 to the movable member 210 thereby moving the movable member 210 from the disengaged/unlocked position to the engaged/locked position and back again. Many types of devices are capable of transferring motion along one direction to another direction, and the transfer device is not limited to any type of device so capable. However, in certain aspects of the drive system 300, the transfer device is a rocker 260 that is pivotally connected to the actuator 245, the movable member 210 and the jamb 140 or sill 150. As the actuator 245 moves back and forth, the rocker 260 pivots about a pivot on the jamb 140 or sill 150 and moves the movable member 210 between the disengaged/unlocked position and the engaged/locked position.

Referring to FIGS. 11A-11C and 12A-12C and as previously described, one of the sealing systems 200 operates using a drive gate 230, which urges a movable member 210 against an opposing face 255 to form a seal between the meeting rails 190A, 190B. Any drive system 300 capable of driving the drive gate 230 in this manner is acceptable for use with the present door/window system 100. In a present aspect of the door/window system 100, the drive gate 230 is connected drive shaft 280 at the seal pivot 220, and the drive shaft 280 is connected, either directly or indirectly, to other drive members of the drive system 300. As the drive shaft 280 is rotated, the drive gate 230 is also rotated and engages the movable member 210.

Transfer System

Referring to FIGS. 7, 8A-8B, 12A-12C, 13A-13C, a transfer system 290, 295 for use in the door/window system 100 is illustrated. The transfer system 290, 295 transfers motion, such as rotation and linear, from one drive system 300 to another drive system 300. In so doing, the motion generated by a single drive system 300 is capable of driving two or more sealing systems 200 located on different edges of the frame 120, sash 160, and/or meeting rail 190B through the use of one or more transfer systems 290. Alternatively or, in addition to a single drive system 300 driving two or more sealing systems 200, as previously discussed, multiple drive systems 300 can each separately drive one or more sealing systems 200.

Figure 7:
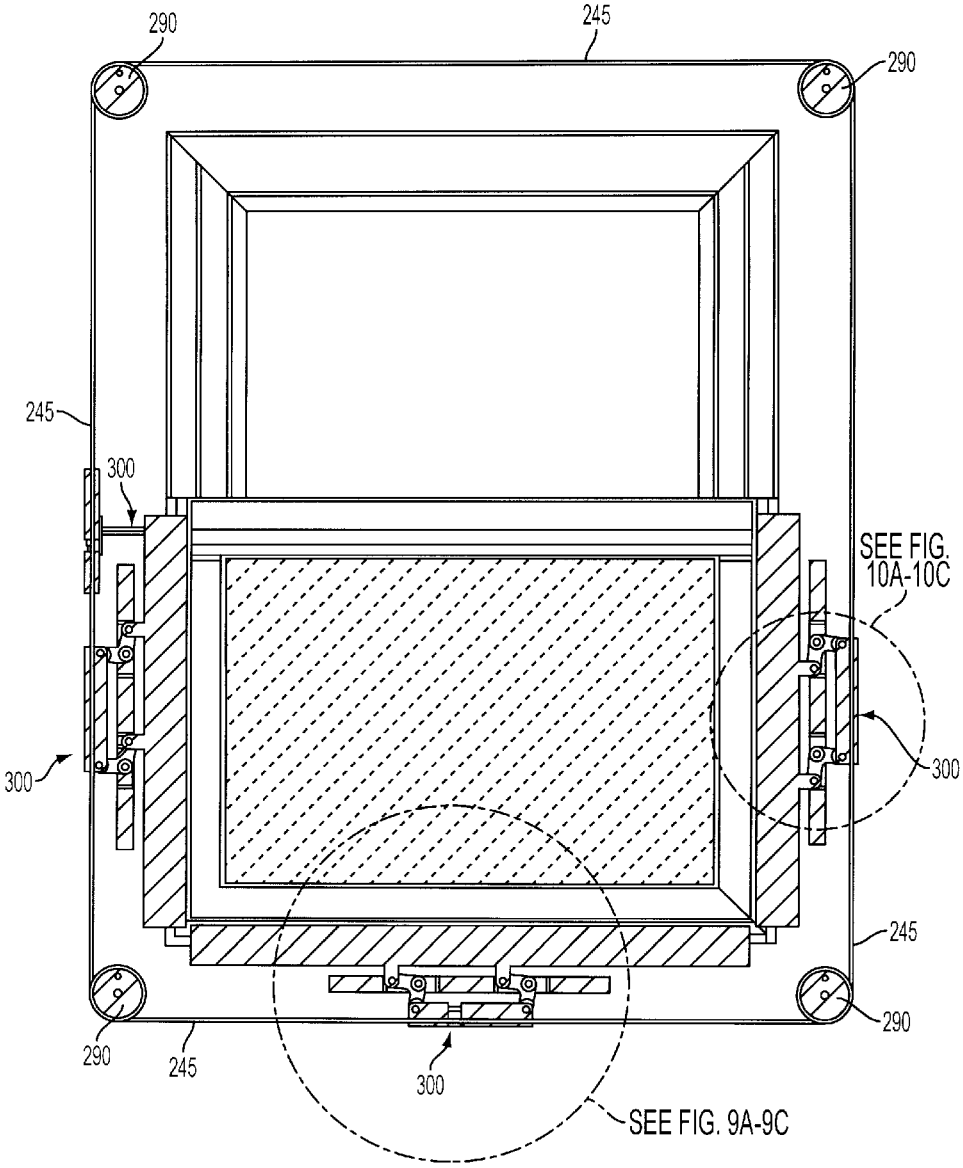
FIG. 7 is a front view of the door/window system showing the interaction of different drive systems and transfer systems, in accordance with the inventive arrangements.
Figure 8A:
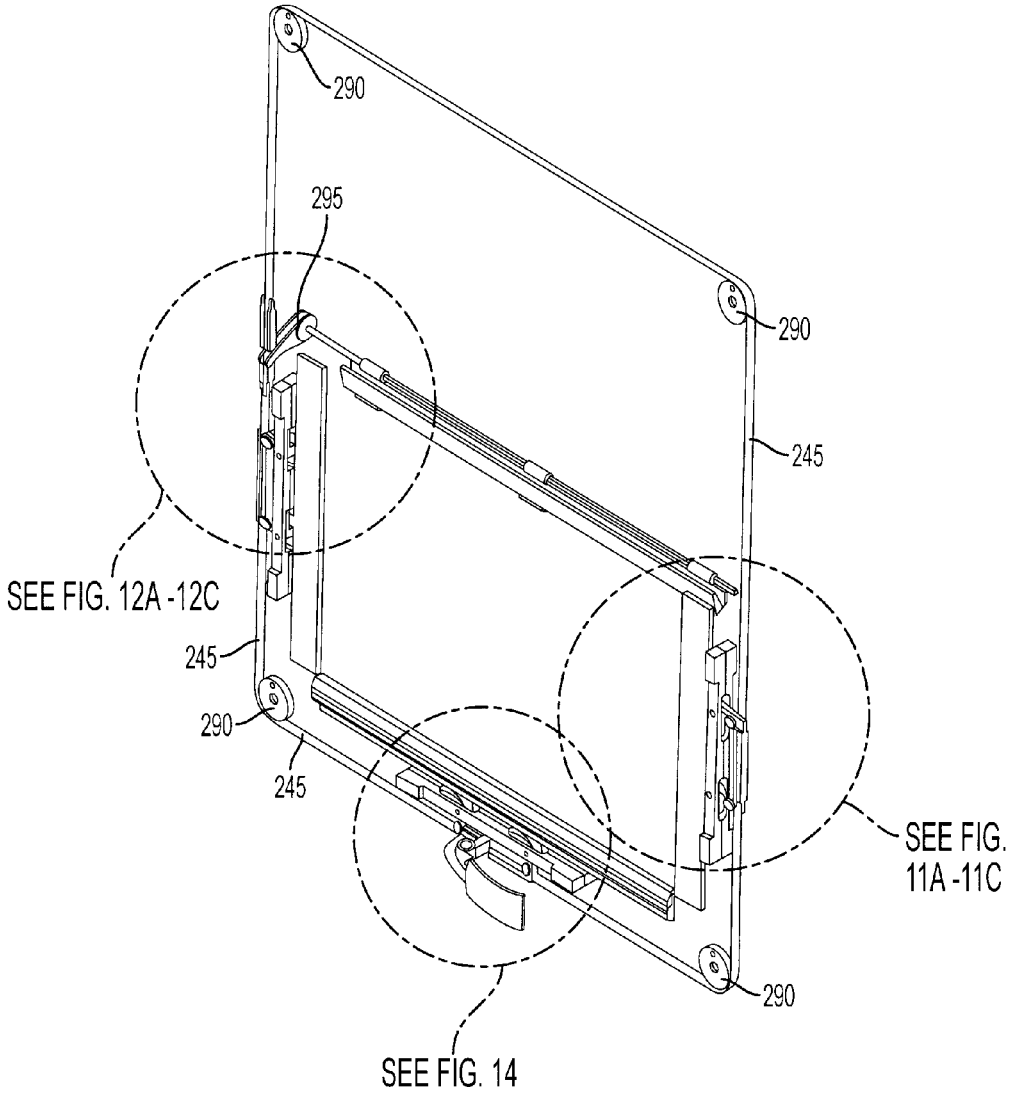
FIGS. 8A and 8B are respectively perspective and side views of the door/window system of FIG. 7 showing the interaction of different drive systems and transfer systems, in accordance with the inventive arrangements.
Figure 8B:
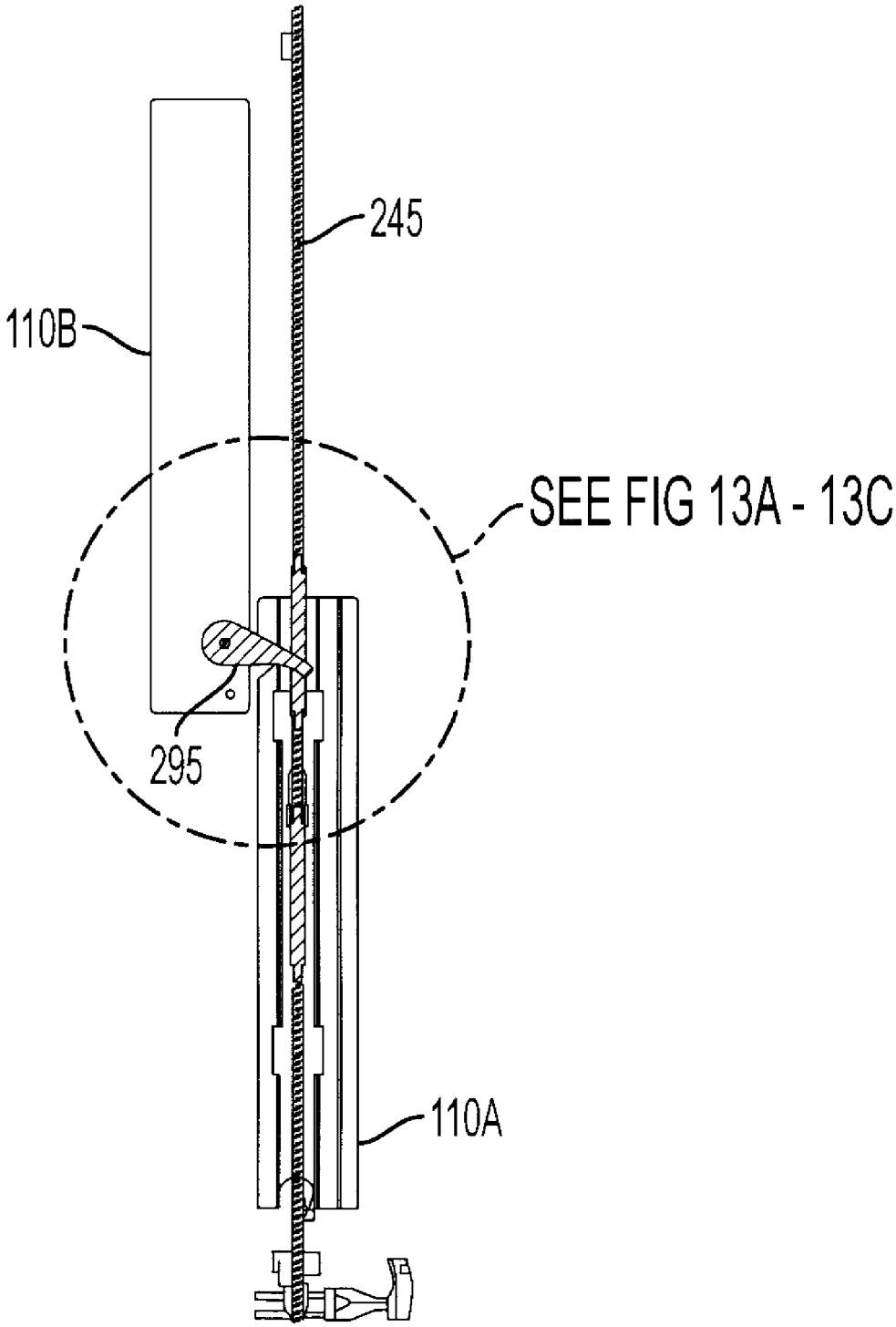

Many types of transfer systems are capable of transferring motion from one drive system 300 to another drive system 300, and the door/window system 100 is not limited as to a transfer system 290, 295 so capable. For example, as illustrated in FIGS. 7 and 8A, the transfer system 290 may include rollers or sprockets that redirect the actuator 245. In so doing, the actuator 245 can be connected to two or more, or even all of the drive systems 300. Referring to FIGS. 8A-8B, 12A-12C, 13A-13C, another transfer system 295 is disclosed. According to this aspect, the transfer system 295 is also connected to the actuator 245 and to the drive shaft 280 of one of the sealing systems 300. In so doing, as the actuator 245 moves up and down, this motion is transferred into a rotation of the drive shaft 280. Additionally, the transfer system 295 may act as a lever arm to create a greater moment about the drive shaft 280.

The actuator 245 works with the transfer systems 290, 295 and the drive systems 300 to transfer motion from one drive system 300 to another drive system 300. Many types of actuators 245 so capable are known, and the door/window system 100 is not limited as to a particular type of actuator 245 so capable. For example, the actuator 245 may be a rigid shaft that rotates or moves linearly. However, in certain aspects of the door/window system 100, the actuator 245 is a chain. In this manner, the actuator 245, as a chain, is both flexible and easily gripped and/or attached to the drive systems 300 and transfer systems 290, 295.

Figure 13A:
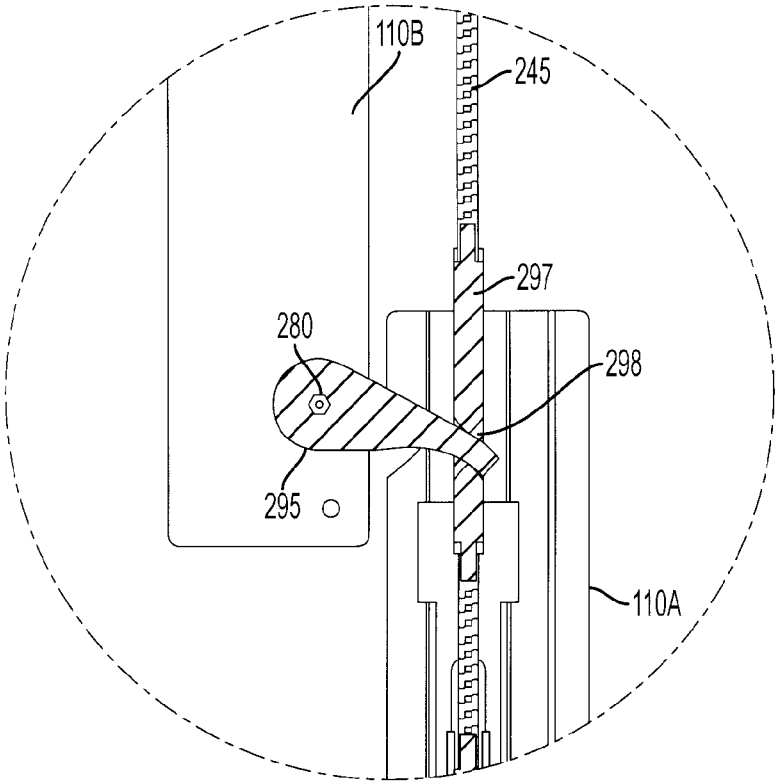
FIGS. 13A-13C are cross-sectional views of the transfer system connecting the drive systems shown in FIGS. 12A-12C, respectively, in the closed and unlocked, partially locked, and locked configurations, in accordance with the inventive arrangements.
Figure 13B:
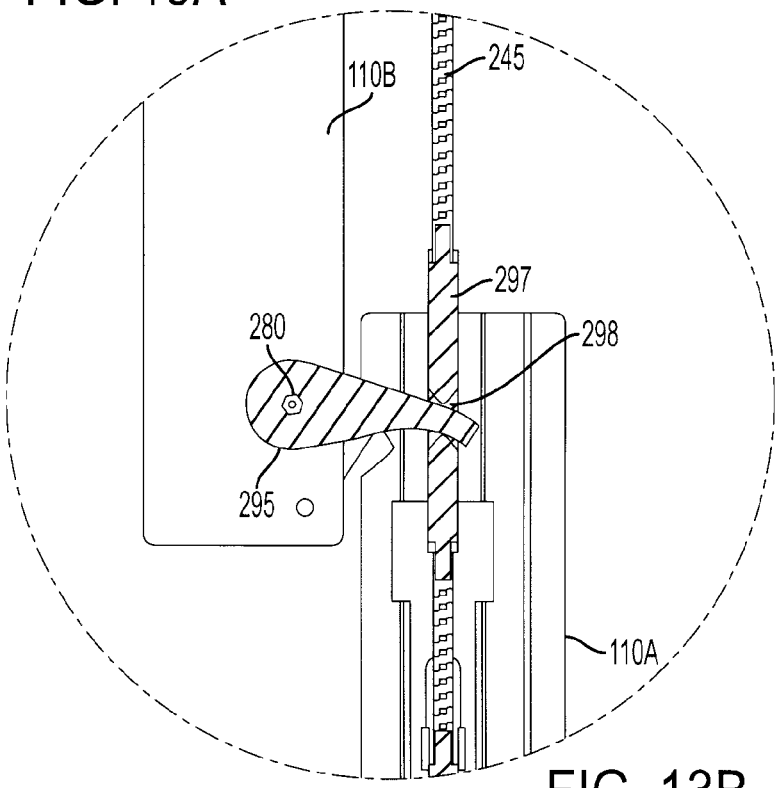
Figure 13C:
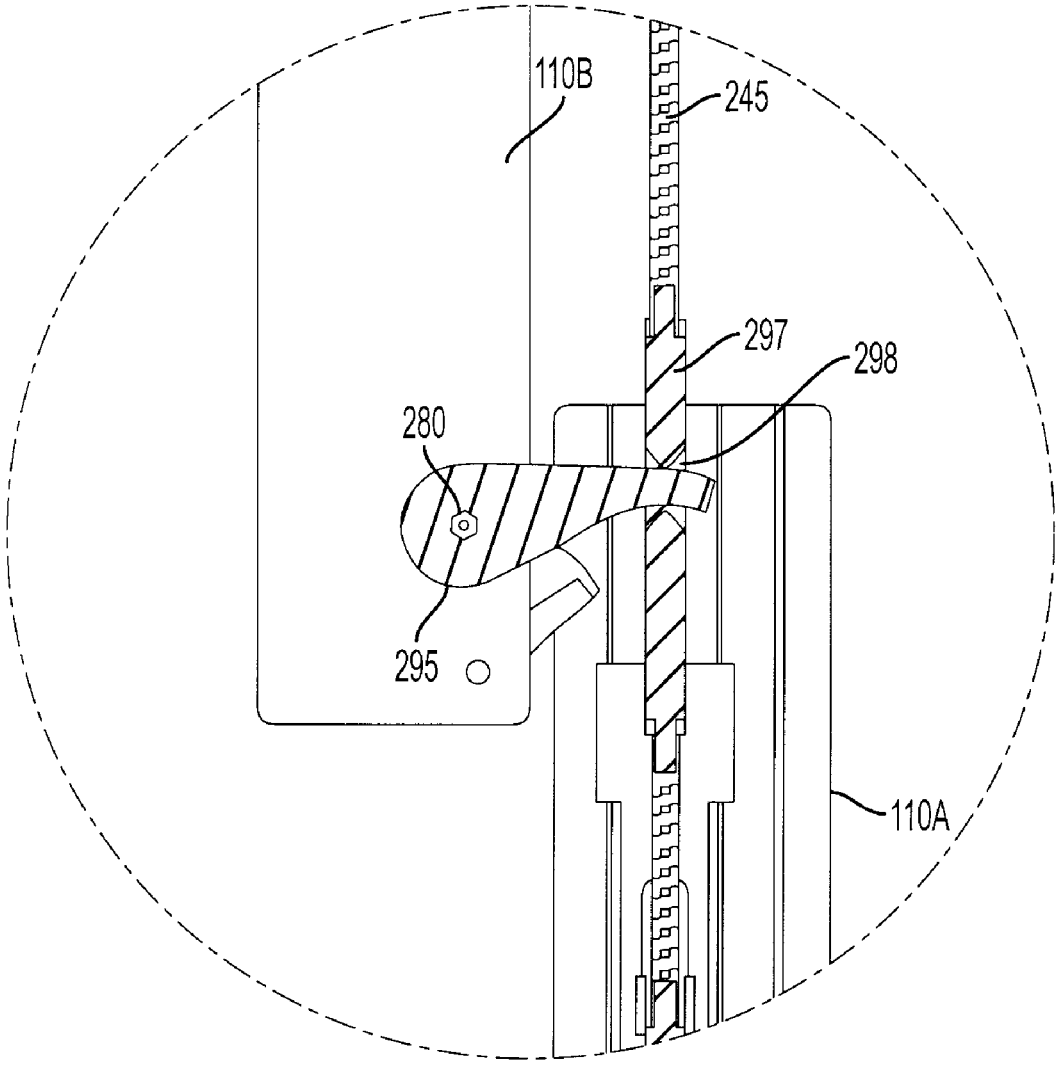
Figure 14:
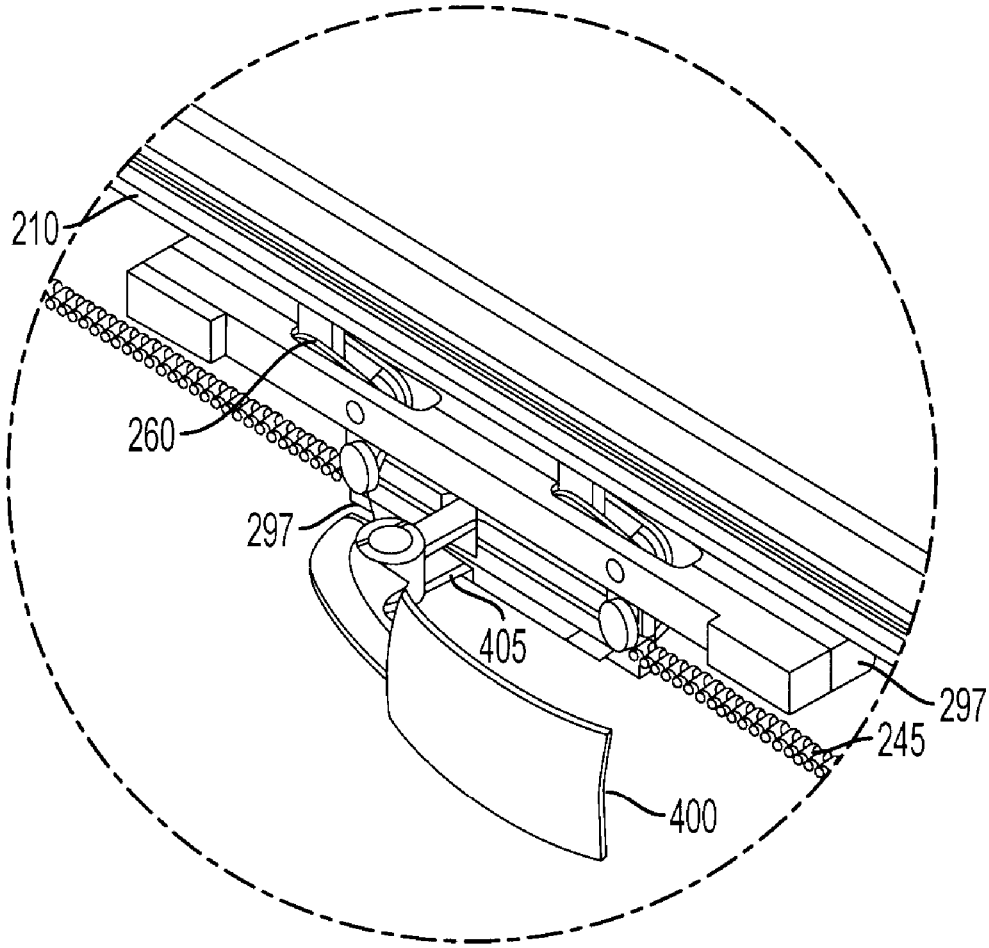
FIG. 14 is a perspective view of a handle for providing motive force to lock the drive systems, in accordance with the inventive arrangements.
Figure 15A:
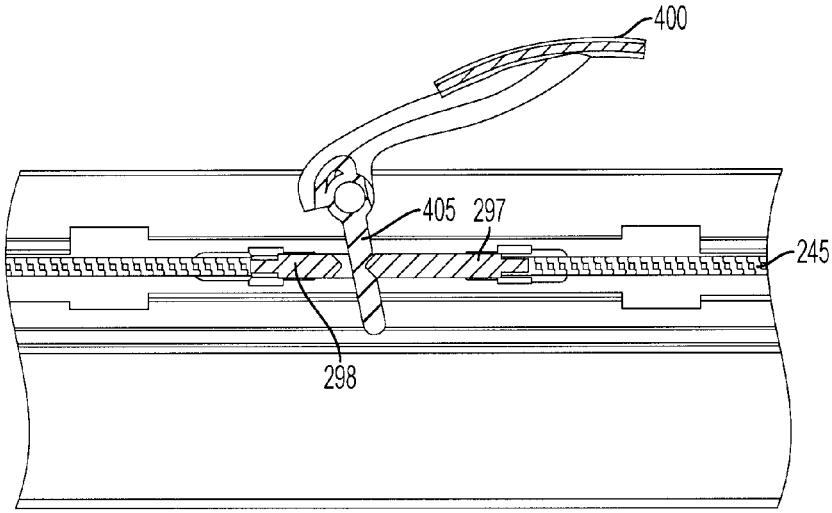
FIGS. 15A-15C are perspective views of the handle connected to an actuator and drive system, in accordance with the inventive arrangements.
Figure 15B:
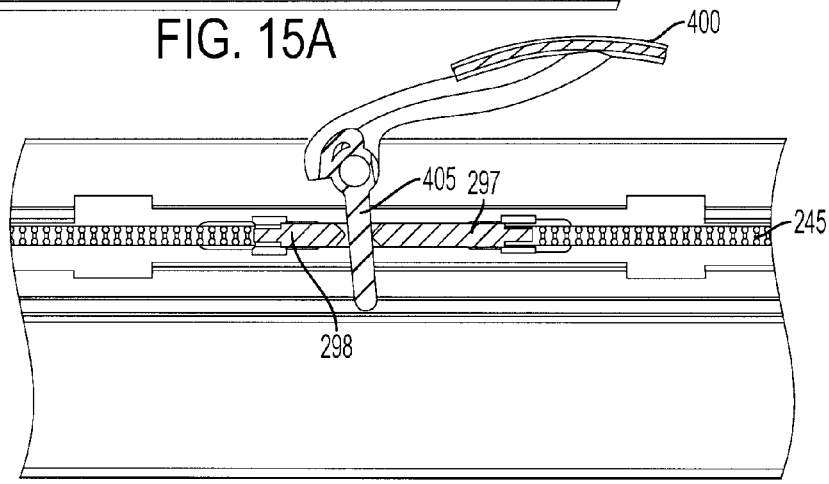
Figure 15C:
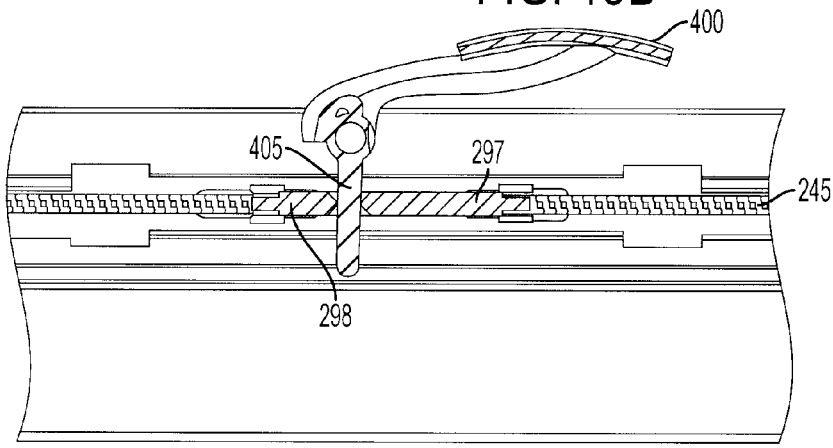
Figure 16A:
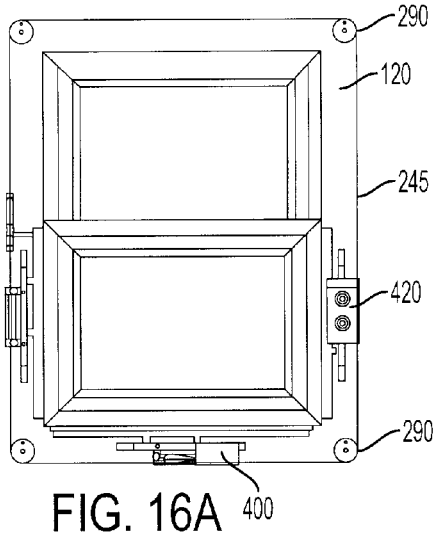
FIGS. 16A-16C are respectively, front, top, and side views of the door/window system including an electro-mechanical lock, in accordance with the inventive arrangements.
Figure 16B:
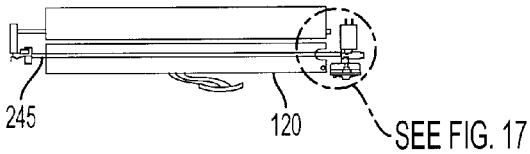
Figure 17:
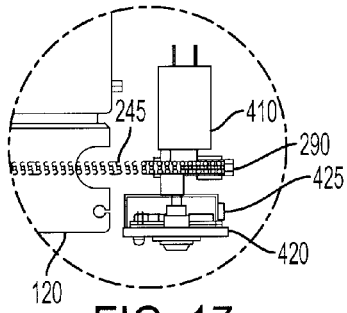
FIG. 17 is a detail view of a motor and transfer system, in accordance with the inventive arrangements.
Figure 16C:
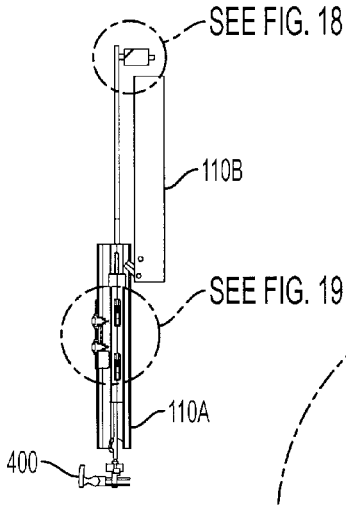
Figure 18:
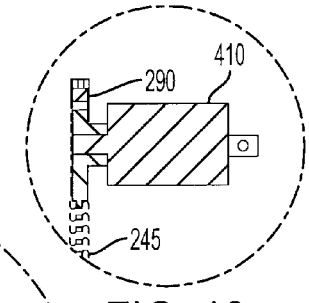
FIG. 18 is a side view of the motor and the transfer system, in accordance with the inventive arrangements.
Figure 19:
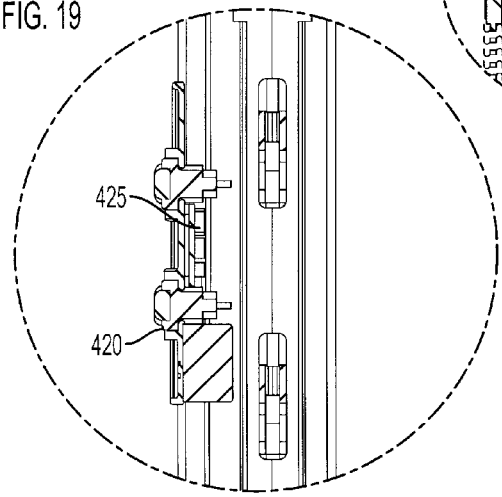
FIG. 19 is a side view of the electro-mechanical lock, in accordance with the inventive arrangements.

The actuator 245 may be directly attached to the drive systems 300, or, as illustrated, the drive systems 300 may be connected to a chain support 297. In addition to act as a connector between the actuator 245 and the drive system 300, the chain support 297 may also be used to limit the motion of the actuator 245. For example, referring to FIGS. 13A-13C, the chain support 297 may include a slot 298 that engages the transfer system 295. As illustrated in FIG. 13A, the angular rotation of the transfer system 295 relative to the chain support 297 past a certain position is limited by the configuration of the slot 298.

Drive Mechanisms

Many types of motive power is capable of being supplied to the drive systems 300, and the door/window system 100 is not limited as to a particular device or manner so capable. For example, referring to FIGS. 14 and 15A-15C, a manual handle 400 is disclosed. The handle 400 is used to move the actuator 245 back and forth and, in so doing, provides motive power to the drive systems 300. The handle 400 is not limited in the manner in which the handle 400 is connected to the actuator 245. However, in certain aspects, the handle 400 is connected to a chain support 297 via an extender 405. Moreover, as with the transfer system 295 described in FIGS. 13A-13C, the chain support 297 may include a slot 298 that engages the extender 405 and limits the angular rotation of the extender 405 relative to the chain support 297 past a certain position.

Referring to FIGS. 16A-16C and FIGS. 17-19, in addition to, or as an alternative to the handle 400, an electro-mechanical system 420 may be provided to supply motive power to the drive systems 300. The electro-mechanical system 420 may include a control board 425 that electrically controls a motor 410, which drives the actuator 245. Although not limited in this manner, the motor 410 can be connected to the actuator via at least one of the transfer systems 290. In so doing, the rotation of the motor 410 can be transferred into back and forth motion of the actuator 245. The control board 425 may also be connected to a remote control device (not shown) for activating the control 425 board.

The electro-mechanical system 420 is not limited in the manner in which the electro-mechanical system 420 receives electrical power. For example, the electro-mechanical system 420 may receive electrical power from a battery located within the frame 120 or the panel 110. In addition to, or alternatively, the electro-mechanical system 420 may receive electrical power from line voltage via the structure in which the door/window system 100 is installed.

What is claimed is:

1. A sealing system for creating a seal between a panel and a frame, the sealing system comprising:

a frame;

a first panel coupled to the frame;

a second panel coupled to the frame, wherein the second panel is parallel to the first panel;

a first active sealing module, wherein the first active sealing module engages a sill rail of the first panel with a sill of the frame;

a second active sealing module, wherein the second active sealing module engages a meeting rail of the first panel with a meeting rail of the second panel within the frame;

a third active sealing module, wherein the third active sealing module engages a stile rail of the sash with a jamb of the frame, wherein upon the first panel being in a closed position relative to the frame, each of the first, second, and third active sealing systems modules having a locked configuration and an unlocked configuration, wherein an active seal is created between a surface of the first panel and a surface of the frame or between the meeting rails of the first and second panels only in the locked configuration of the respective active sealing modules, and wherein the active seal is created along substantially an entire side of the first panel and the frame or along substantially entirely along the meeting rail of the first panel and the meeting rail of the second panel.

2. The sealing system of claim 1, wherein the first panel slides relative to the frame.

3. The sealing system of claim 1, wherein multiple active sealing modules are provided to respectively engage all pairs of adjacent surfaces between the first panel and the frame and between the first panel and the second panel.

4. The sealing system of claim 3, wherein engagement of the first active sealing module causes engagement of all the active sealing modules.

5. The sealing system of claim 1, wherein the first active sealing module having a different configuration than the second active sealing module.

6. The sealing system of claim 1, wherein the first panel movable relative to the frame in a first direction towards a single closed position, the first active sealing module creates the active seal between the sill rail of the first panel and the sill of the frame, wherein the first active sealing module includes a movable member pivoting between an engaged position and an unengaged position, and upon the first panel being in a single closed position relative to the frame:

the first active sealing module having a locked configuration and an unlocked configuration, the active seal being created between the sill rail of the first panel and the sill of the frame only in the locked configuration of the first active sealing module, and in the locked configuration and while the first panel is stationary relative to the frame, the movable member in the engaged position preventing movement of the first panel in a second direction opposite to the first direction.

7. The sealing system of claim 1, further comprising an electro-mechanical system for providing power to move each of the first, second, and third active sealing modules from the unlocked configuration to the locked configuration.

8. A sealing system for creating a seal between a panel and a frame, the sealing system comprising:

a frame;

a panel coupled to the frame, wherein the panel is movable relative to the frame in a first direction towards a single closed position;

an active sealing module, wherein the active sealing module creates an active seal between a first surface of the panel and a first surface of the frame, wherein:

the active sealing module includes a movable member pivoting between an engaged position and an unengaged position, and upon the panel being in a single closed position relative to the frame:

the active sealing module having a locked configuration and an unlocked configuration, the active seal being created between the first surface of the panel and the first surface of the frame only in the locked configuration of the active sealing module, the active seal being created along substantially an entire side of the panel and the frame, and in the locked configuration and while the panel is stationary relative to the frame, the movable member in the engaged position preventing movement of the panel in a second direction opposite to the first direction.

9. The sealing system according to claim 8, further comprising a drive member engaging the movable member, the engagement of the drive member with the movable member pivoting the movable member from the unengaged position to the engaged position.

10. The sealing system of claim 9, wherein the frame includes a lip and the movable member pivots about the lip.

11. The sealing system of claim 10, wherein the movable member floats freely between the lip and the drive member.

12. The sealing system of claim 10, wherein the movable member includes a tip, a tail, and a neck, the neck is positioned between the tip and the tail, and the neck is positioned between the lip and the drive member.

13. The sealing system of claim 12, wherein a distance between the lip and a portion of the drive member facing the lip is smaller than a width of the tail and a width of the tip.

14. The sealing system of claim 8, wherein the panel includes a recess into which the movable member extends, the recess includes an inwardly-extending nook, the inwardly-extending nook includes the first surface of the panel, and in the engaged position, the movable member positioned within the inwardly-extending nook and against the first surface of the panel.

15. The sealing system of claim 8, wherein the active seal is created along substantially an entire side of the panel and the frame.

* * * * *

UNITED STATES PATENT AND TRADEMARK OFFICE

CERTIFICATE OF CORRECTION

PATENT NO. : 8,109,037 B2
APPLICATION NO. : 11/846139
DATED : February 7, 2012
INVENTOR(S) : William Kip Speyer et al.

It is certified that error appears in the above-identified patent and that said Letters Patent is hereby corrected as shown below:

On the Title Page: Item (75), in the list of inventors, "Don S. Solerno" should be "Don S. Salerno".

Signed and Sealed this
First Day of May, 2012

David J. Kappos

David J. Kappos
*Director of the United States Patent and Trademark Office*